United States Patent [19]

Nikaido

[11] Patent Number: 4,555,237

[45] Date of Patent: Nov. 26, 1985

[54] WALKING AND ROLLING TOY

[75] Inventor: Teruo Nikaido, Tokyo, Japan

[73] Assignee: Tomy Kogyo Company, Incorporated, Japan

[21] Appl. No.: 628,527

[22] Filed: Jul. 6, 1984

[30] Foreign Application Priority Data

Nov. 25, 1983 [JP] Japan ..... 58-182379
Dec. 10, 1983 [JP] Japan ..... 58-190813

[51] Int. Cl.[4] ..... A63H 3/22; A63H 29/02

[52] U.S. Cl. ..... 446/355; 446/378; 446/462

[58] Field of Search ..... 446/289, 290, 291, 292, 446/293, 294, 352, 353, 354, 355, 462, 463, 437, 457, 461, 376, 377, 378

[56] References Cited

U.S. PATENT DOCUMENTS

| | | | |
|---|---|---|---|
| 596,109 | 12/1897 | Gedney | 446/291 |
| 2,667,719 | 2/1954 | Edwardson | 446/355 |
| 4,170,840 | 10/1979 | Ogawa | 446/95 |
| 4,177,602 | 12/1979 | Choi | 446/355 |
| 4,183,173 | 1/1980 | Ogawa | 446/94 |
| 4,206,564 | 6/1980 | Ogawa | 446/94 |
| 4,365,437 | 12/1982 | Jameson | 446/355 |
| 4,443,967 | 4/1984 | Jones et al. | 446/462 |
| 4,454,679 | 6/1984 | Ogawa | 446/289 |
| 4,475,305 | 10/1984 | Kawakami et al. | 446/463 |

*Primary Examiner*—Robert A. Hafer
*Assistant Examiner*—Daniel Nolan
*Attorney, Agent, or Firm*—K. H. Boswell

[57] ABSTRACT

A toy has a body with a fly wheel rotatably mounted in the body. First and second appendages are rotatably mounted to the body and are connected to the fly wheel by a gear train. Further, a member is movably mounted on the body. When the member is in a first position the gear train is connected between the fly wheel and the appendages to move the appendages and propel the toy in a walking-like manner across a support surface. When the member is in a second position on the body the gear train is disrupted, the body is flipped so as to rest on the fly wheel, and the body is then rolled by the fly wheel across a support surface.

16 Claims, 12 Drawing Figures

WALKING AND ROLLING TOY

BACKGROUND OF THE INVENTION

This invention is directed to a toy which utilizes a fly wheel to move the toy by transfer of rotational motion of the fly wheel to appendages attached to the body. The appendages move with respect to the body under motion imparted to them by the fly wheel.

A number of moving toys are known which utilize fly wheels as an energy source for propelling the toy. Generally however, most of these toys are wheeled vehicles. In the wheeled vehicle type toys, the fly wheel can serve directly as one of the wheels of the vehicle and as such it is a driving wheel, or it can be nested inside the body of the toy and connected to a drive wheel via gears or the like.

The above noted fly wheel propelled vehicle toys are very advantageous because the child playing with the toy can repeatedly energize the fly wheel utilizing muscle power and does not have to rely on batteries or the like which lose their charge and must continually be replaced.

At least one other type of moving toy is known which utilizes a fly wheel for its energy source. A walking toy is described in U.S. Pat. No. 4,365,437. This toy includes a linkage which is oriented transverse with respect to the fore/aft direction of movement of the toy. The fly wheel, or gyroscopic element, as noted in this toy, is oriented so as to rotate in the fore/aft axis. The linkage is attached to the fly wheel such that it first lifts one of its ends and then the other of its ends. This, in itself, does not propel the toy forward. However, when this is combined with the gyroscopic procession of the rotating fly wheel, the toy pivots first around one end of the linkage and then around the other to move forward in a waddling like manner. Because of the very nature of this movement, this toy is not capable of rapid movement across a support surface as are the above referred to wheel vehicle type toys.

BRIEF DESCRIPTION OF THE INVENTION

In view of the advantages of flywheel type toys, it is considered that there exists a need for new and improved toys which rely upon fly wheels as their energy source but which are capable of moving in novel manners. It therefore is a broad object of this invention to provide such a toy. It is a further object of this invention to provide a toy which is capable of moving in a walking like manner utilizing appendages which are driven by the fly wheel but is further capable of moving in a rolling manner utilizing the rotation of the fly wheel to directly propel the toy. Additionally, it is an object of this invention to provide a toy which, because of its construction and engineering principles inherent therein is capable of a long and useful lifetime, yet is capable of being manufactured in an economical manner so as to be readily available to the consuming public.

These and other objects as will become evident from the remainder of this specification are achieved in a movable toy which comprises: a body; a fly wheel rotatably mounted on said body; means for rotating said fly wheel so as to energize said fly wheel; appendage means for supporting and moving said toy on a support surface, said appendage means having ends, said appendage means pivotally connected to said body about one of said ends, the other of said ends of said appendage means contacting said support surface; a member movably mounted on said body so as to move between a first and second position; motion transfer means for transferring motion from said fly wheel to said appendage means, said motion transfer means operatively connectable between said fly wheel and said appendage means and further operatively associated with said member whereby when said member is in said first position said motion transfer means is connectable between said fly wheel and said appendage means and when said member is in said second position said connection between said fly wheel and said appendage means is disrupted.

Further, these objects are achieved in a movable toy which comprises: a body; a fly wheel rotatably mounted on said body; means for rotating said fly wheel so as to energize said fly wheel; a crank shaft rotatably mounted on said body in operative association with said fly wheel so as to be rotated by said fly wheel; said crank shaft being elongated and including ends, said crank shaft located on said body so as to extend through said body with the respective ends of said crank shaft extending out of respective sides of said body, said crank shaft including a crank on each of its respective ends, each of said cranks of a type including a crank pin connected by a web to said crank shaft, the crank pins on each of said cranks orbiting about said crank shaft in response to rotation of said crank shaft; at least two appendage elements rotatably mounted on said body, each of said appendage elements having a first and second appendage member, said first appendage member having ends, said first appendage member rotatably mounted to the crank pin of the respective crank associated with said appendage element, said first appendage member executing movement in response to rotation if said crank shaft, said second appendage member having ends, said second appendage member pivotally mounted to said first appendage member, said second appendage member slidably connected to said crank shaft proximal to one of the ends of said second appendage member, said second appendage member pivoting on said first appendage member in response to rotation of said crank shaft.

BRIEF DESCRIPTION OF THE DRAWINGS

This invention will be better understood when taken in conjunction with the drawings wherein.

Figure 1:
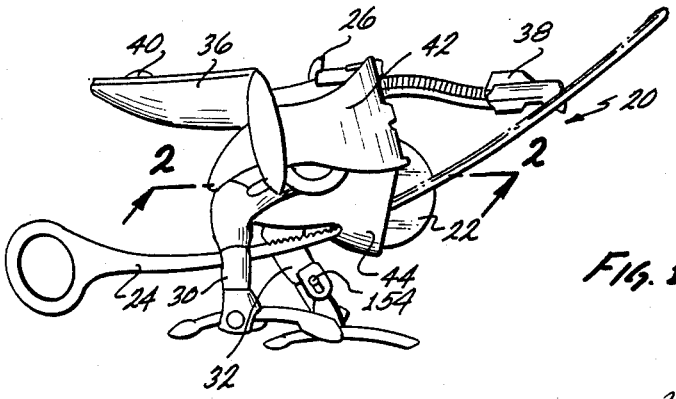
FIG. 1 is a side elevational view of an embodiment of the invention.

The invention described in this specification and illustrated in the drawings utilizes certain principles and/or concepts as are set forth in the claims appended hereto. Those skilled in the toy arts will realize that these principles and/or concepts are capable of being employed in a variety of embodiments which may differ from the exact embodiment utilized for illustrative purposes herein. For this reason, this invention is not to be construed as being only limited to the illustrative embodiment but is only to be construed in view of the claims.

DETAILED DESCRIPTION OF THE INVENTION

In FIG. 1 a toy 20 of this invention is shown. The overall appearance of the toy 20 as seen in FIG. 1 is that of a two-legged bird-like character. The toy 20 includes a fly wheel 22. The fly wheel 22 is energized utilizing a flexible gear rack 24 which interacts with a gear described later which is attached to the fly wheel 22. By rapidly pulling the gear rack 24 across this gear, the fly wheel 22 is rapidly rotated and is energized.

Once the fly wheel 22 is energized, a switch 26 can be pushed forward to engage certain gears as hereinafter described which transfers rotation of the fly wheel 22 to a crank shaft 28 seen in FIG. 3 which ultimately causes movements of two legs 30 and 32 movably mounted to the toy 20. The legs 30 and 32 are very bird-like in appearance. The toy 20 can then walk across a support surface under motion imparted to the toy 20 by walking movement of the legs 30 and 32.

After the toy 20 has "walked" a certain distance, a latch 34 is released from a member 36 which, among other things, carries a head 38 thereon. When the latch 34 releases from the member 36, the member 36 moves from the position seen in FIG. 1 and also seen in FIG. 11 in phantom lines, to the position seen in solid line in FIG. 11. In doing so, sufficient momentum is imparted to the toy 20 such that is rotates forward from the position seen in phantom line in FIG. 12 (in solid line in FIG. 11) to the position seen in solid line in FIG. 12. This lifts the legs 30 and 32 up off the support surface and rests the toy 20 on the fly wheel 22 as well as on a small wheel 40 located on the member 36. The toy 20 is now propelled forward in a rolling manner on both the wheel 40 and the fly wheel 22 by the rotational momentum still remaining in the fly wheel 22.

Figure 11:
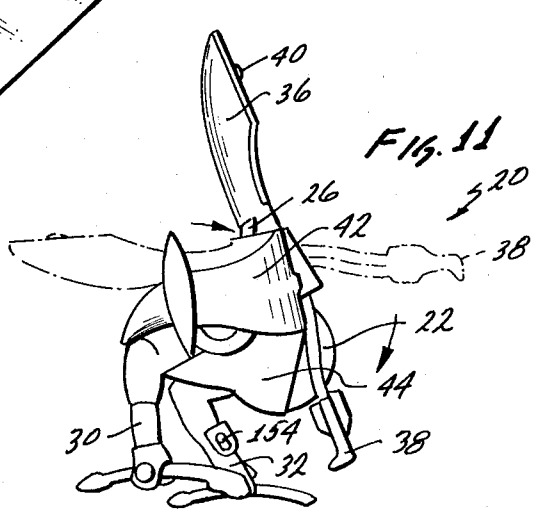
FIG. 11 is a side elevational view of the embodiment of FIG. 1 showing certain portions of that embodiment in phantom lines corresponding to the positions shown in FIG. 1 and in solid line corresponding to a new position.
Figure 12:
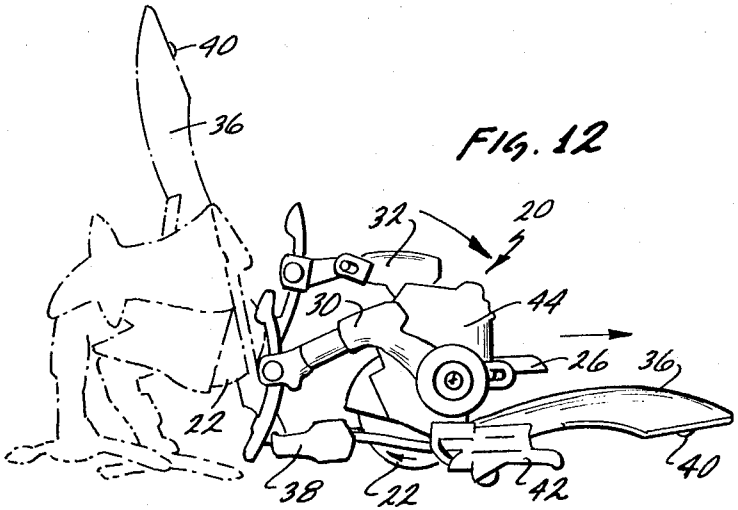
FIG. 12 is a view similar to FIGS. 1 and 11 showing the toy in phantom line in the position as seen in FIG. 11 and in solid line in a new position.

Concurrent with movement of the member 36 from its first position as seen in FIG. 1, to its second position, that seen in FIGS. 11 and 12, two wing members, only one of which is seen, wing member 42, unfold from a tucked position for the bird-like character of FIG. 1 to an open position, such that the toy 20 in the configuration seen in FIG. 12 takes on the character of a flying machine, airplane, space ship or the like.

The movement of the toy 20 when it is in its bird-like configuration in FIG. 1 is that of an animated walking or running-like motion, while the movement of the toy 20 when it is in its second or space ship-like configuration in FIG. 12, is that of a more conventional rolling motion. While the legs 30 and 32 move with respect to the body 44 of the toy 20 when in the configuration of FIG. 1, when the toy assumes the configuration of FIG. 12, the legs 30 and 32 cease movement with respect to the body 44. This contributes to the overall change of character of the toy moving from FIG. 1 to FIG. 12 as well as serving to conserve the momentum of the fly wheel 22, in that when the toy 20 is no longer supported and moved by the legs 30 and 32, the momentum of the fly wheel is no longer utilized to drive or move them with respect to the body 44.

Looking now at FIGS. 2 through 6, and FIG. 8, the motion transfer means which transfers rotational motion of the fly wheel 22 to translational movement of the leg appendages 30 and 32, is shown. The fly wheel 22 is mounted to the body 44 via an axle 46 which passes through a central hub portion 48 of the fly wheel 22. The hub portion 48 carries a set of gear teeth 50 on one of its ends and a further set of gear teeth 52 on the opposite end. The gear teeth 52 are engaged by the gear rack 24 to energize the fly wheel 22. The gear rack 24 is inserted within a slot, not separately numbered or shown, within the body 44 which positions it in direct engagement with the gear teeth 52 such that the fly wheel 22 can be energized by rapid removal of the gear rack 24 from the body 44 as previously noted. Once set spinning, the fly wheel 22 then transfers rotation to other components via the gear teeth 50.

The gear teeth 50 engage a spur gear 54 which is integrally formed with a pinion 56. Both of these are rotatably mounted on the inside of the body 44 via a pin 58. The pinion 56 engages a sour gear 60 which is integrally formed with a pinion 62. Both of these are loosely held on the crank shaft 28 and do not rotate in conjunction with the crank shaft 28. A spur gear 64 is fixed to a shaft 66. The shaft 66 is mounted in slots, collectively identified by the numeral 68, formed on opposite sides of the body 44. A shift member 70 has the switch 26 integrally formed as a part thereof. It further includes a left and right bifurcated arm, collectively identified by the numeral 72. The bifurcated arms 72 fit over the shaft 66 and move the shaft 66 forward and backward within the slots 68. This serves as a control means to engage and disengage the spur gear 64 with the pinion 62.

Figure 8:
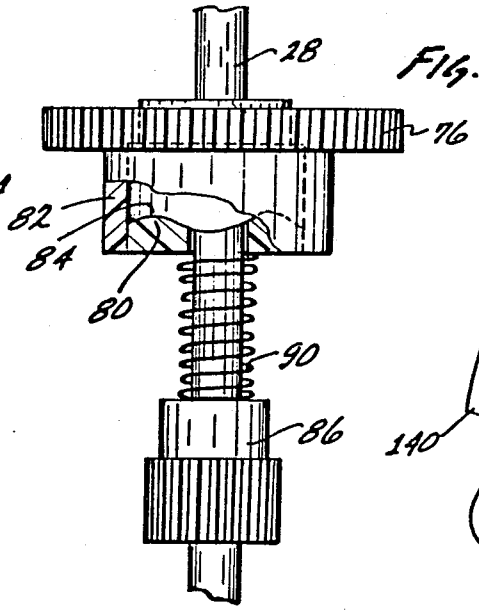
FIG. 8 is a fragmentary plan view of one of the components located in the center of FIG. 2.

Movement of the shaft 66 also engages a pinion 74, which is fixed to the shaft 66 in mesh with a large spur gear 76 which is carried on the crank shaft 28. The spur gear 76 transfers rotation to the crank shaft 28 via a clutch mechanism which is seen in FIG. 8. A bushing 78 is fixed to the crank shaft 28. The bushing 78 has a series of undulations which serve as a re-entrant gear 80. The spur gear 76 has a bushing portion 82 formed as a part thereof which has a corresponding set of undulations which serve as a second re-entrant gear 84. A bushing 86 is fixed to the crank shaft 28. The bushing 86 includes a pinion 88 formed in combination with the bushing 86. A spring 90 is compressed between the bushing 86 and the bushing 82. This engages the re-entrant gear 84 with the re-entrant gear 80 such that rotation of the spur gear 76 is transferred to the bushing 78 which in turn transfers it to the crank shaft 28. This also transfers rotation to the bushing 86 and the pinion 88.

A member 92 is carried on the shaft 66, however it does not rotate in conjunction with the shaft 66. It includes a spur gear 94 and a spiral gear 96 integrally formed as a part of the member 92. An arm 98 has a bushing 100 formed as its lowermost portion with the latch 34 formed as its upper portion. The arm 98, in conjunction with the spiral gear 96, serves as a control means for releasing the latch 34 from the member 36.

Figure 5:
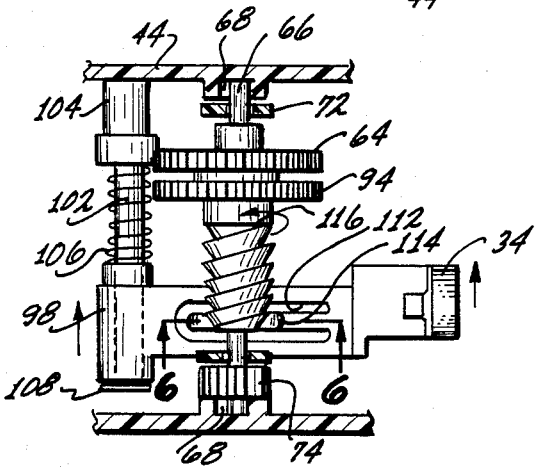
FIG. 5 is a front elevational view of certain of the components seen in FIG. 3.
Figure 7:
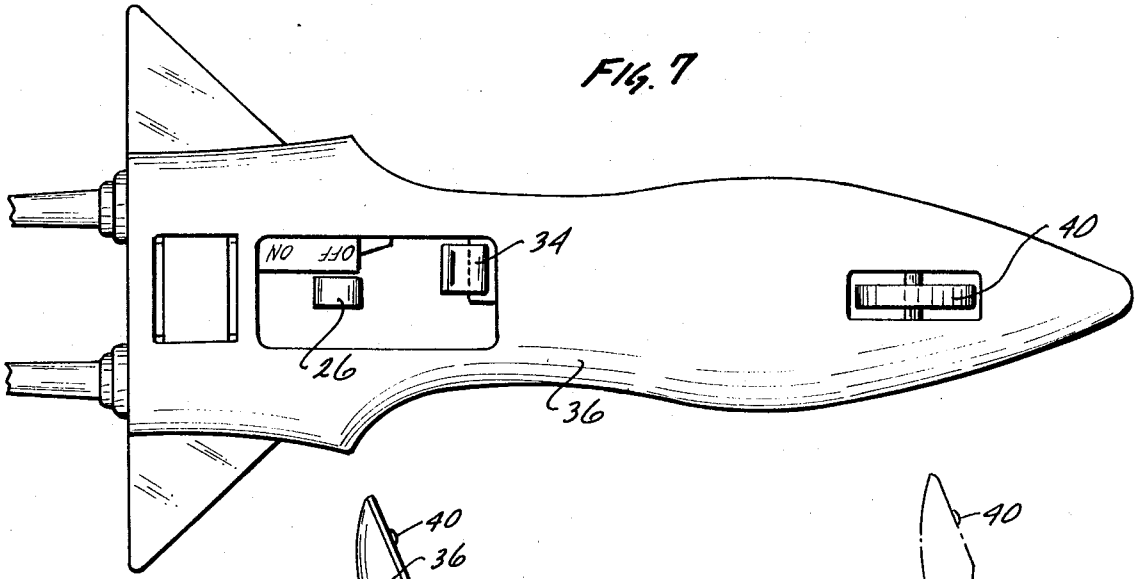
FIG. 7 is a top plan view of a portion of the toy as seen in FIG. 1.

The bushing 100 is free to rotate and slide along a shaft 102 which is mounted within a boss 104 held within the body 44. A spring 106 is located around the shaft 102 and is compressed between the boss 104 and the bushing 100. A head 108 on the shaft 102 prevents the spring 106 from pushing the bushing 108 off of the shaft 102. The spring 106, however, biases the arm 98 and bushing 100 downwardly as seen in FIG. 5. This corresponds to the position of the latch 34 as is seen in FIG. 7.

The ends of the spring 106 are straightened out from the cylindrical spiral portion of the spring 106 which wraps around the shaft 102. One of the ends is hooked to a boss 110 formed within the body 44 with the other of the ends engaging the arm 98. This urges or biases the arm 98 toward the spiral gear 96. Thus, the spring 106 serves to both move the arm 98 along the shaft 102 and also to rotate the arm 98 about the shaft 102 toward the spiral gear 96.

As seen in FIG. 5, the central portion of the arm 98 includes a cut-out area 112 having a central member 114 located therein. The central member 114 includes a small curved section formed thereon which engages with the spiral gear 96. The curved section is cocked on the central member 114 such that it has about the same slant or pich to it that the spiral gear 96 has such that it can smoothly engage the spiral gear 96. Since the spiral gear 96 is integrally formed with the spur gear 94, it rotates with the spur gear 94. Along with engaging the spur gear 64 in mesh with the pinion 62, the shift member 70 in sliding the shaft 66 also engages the spur gear 94 with the pinion 88 which is fixed to the crank shaft 28. As the crank shaft 28 is rotated, it thus rotates the spur gear 94 and the spiral gear 96.

Figure 4:
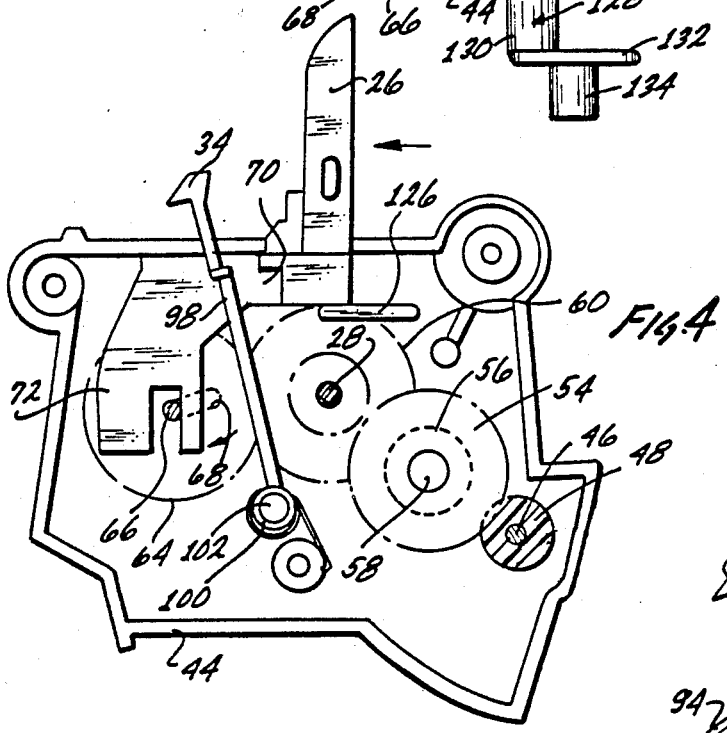
FIG. 4 is a side elevational view in partial section taken about the line 4—4 of FIG. 3.
Figure 6:
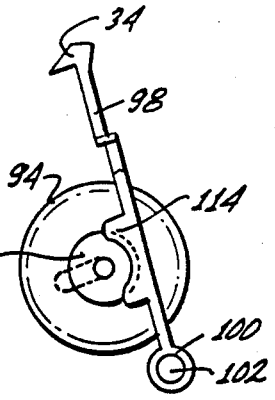
FIG. 6 is a fragmentary side elevational view of certain of the components of FIG. 2.

Rotation of the spiral gear 96 moves the central member 114 and arm 98 to which it is attached along the surface of the spiral gear 96. This moves the arm 34 away from the viewer into the plane of the Figures of FIGS. 2, 4 and 6 and upwardly for FIG. 5. This corresponds to downward movement of the latch 34 in FIG. 7. When the central member 114 has been moved all the way along the spiral gear 96 toward the spur gear 94, it is lifted onto the shoulder 116 formed on the member 92 in between the spur gear 94 and the spur gear 96. This moves the arm 98 clockwise as seen in FIGS. 2, 4 and 6 which disengages the latch 34 as seen in FIG. 2 from a small shelf 118 formed on the member 36.

Figure 2:
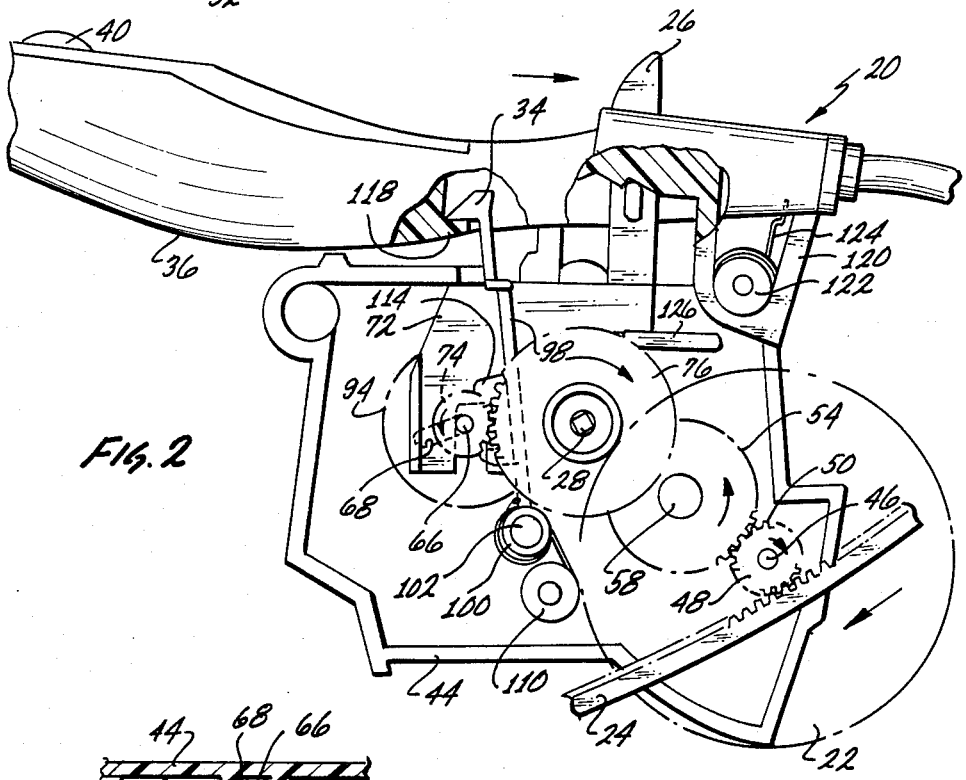
FIG. 2 is a side elevational view in partial section taken about the line 2—2 of FIG. 1.

In FIG. 7 when the central member 114 is positioned on the shoulder 116 the latch 34 has been moved downwardly all the way off of the shelf 118 and this combined with the clockwise rotation as seen in FIG. 2 disengages the latch 34 from the member 36 allowing the member 36 to move between the configurations seen in phantom line in FIG. 11 to the configuration seen in solid line in FIG. 11. The latch 34 in combination with the shelf 118 thus serves as a retaining means for holding the member 36 in the phantom or first position seen in FIG. 11. It is under the control of the arm 98 and the spiral gear 94 which serves as a control means for this latching and unlatching operation.

The member 36 attaches to the body 44 via a small extension 120 formed on its underside. The extension 120 is located around a boss 122 formed as a portion of the body 44. A hairpin spring 124 is wound around the boss 122 with one of its ends engaged against the body 44 and the second of its ends engaged against the member 36. This biases the member 36 from the position seen in phantom lines in FIG. 11 the position seen in solid lines in FIG. 11. When the member 36 is retained by the latch 34, a bias is introduced into the spring 124 such that as soon as the latch 34 releases from the shelf 118 the bias within the spring 124 rotates the member 36 with a certain degree of force such that the momentum of this rotation is transferred to the body 44 when the member 36 is abruptly stopped in the position seen in solid lines in FIG. 11. When this happens that the total of the toy 20 is rotated counterclockwise to the position seen in solid lines in FIG. 12 whereby it is no longer supported by the legs 30 and 32, but instead it is supported on the fly wheel 22 and the wheel 40 on the member 36.

When the member 36 rotates to the position seen in solid lines in FIG. 11, the extension 120 on the member 36 engages a small lip 126 formed on the forward side of the member 70 and shifts the member 70 backward toward the left in FIG. 2 such that shaft 66 and all of the gears carried thereon are also moved to the left in FIG. 2. This disengages the gears 64, 94 and 74 from the respective gears 60, 88 and 76 which immediately ceases the propagation of any motion from the fly wheel 22 to either the leg appendages 30 and 32 or the spiral gear 96 and the associated movement of the arm 98 as it engages this spiral gear. Thus, as soon as the member 36 is shifted to the configuration seen in solid lines in FIG. 11, all movement of the legs 30 and 32 stops, as does movement of the latch 34 such that all momentum remaining in the fly wheel 22 can be utilized to drive the toy 20 forward in a rolling manner on a support surface.

Figure 3:
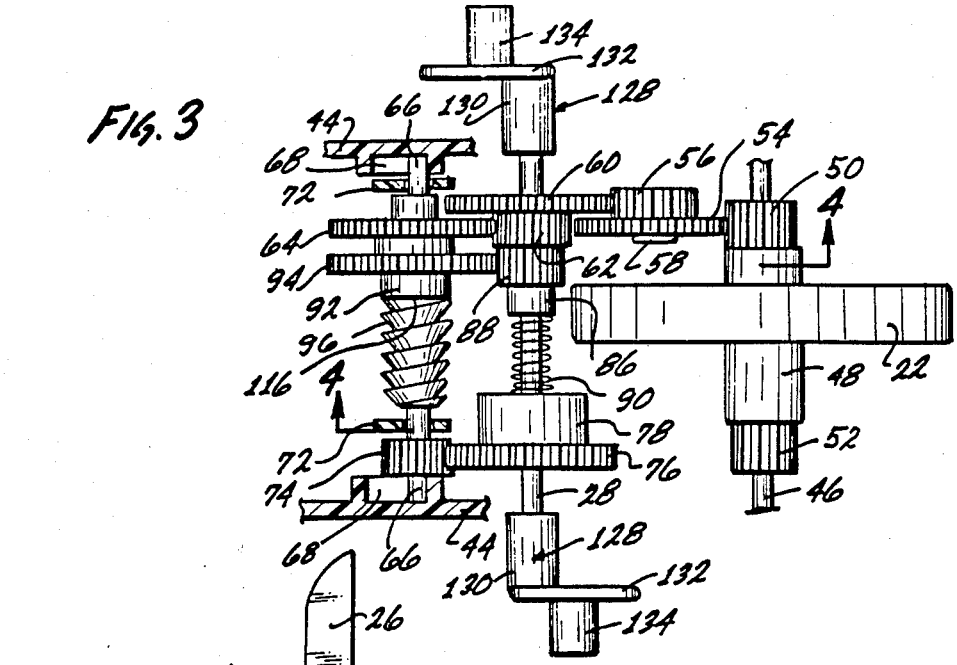
FIG. 3 is a top plan view of certain of the components seen in FIG. 2.
Figure 10:
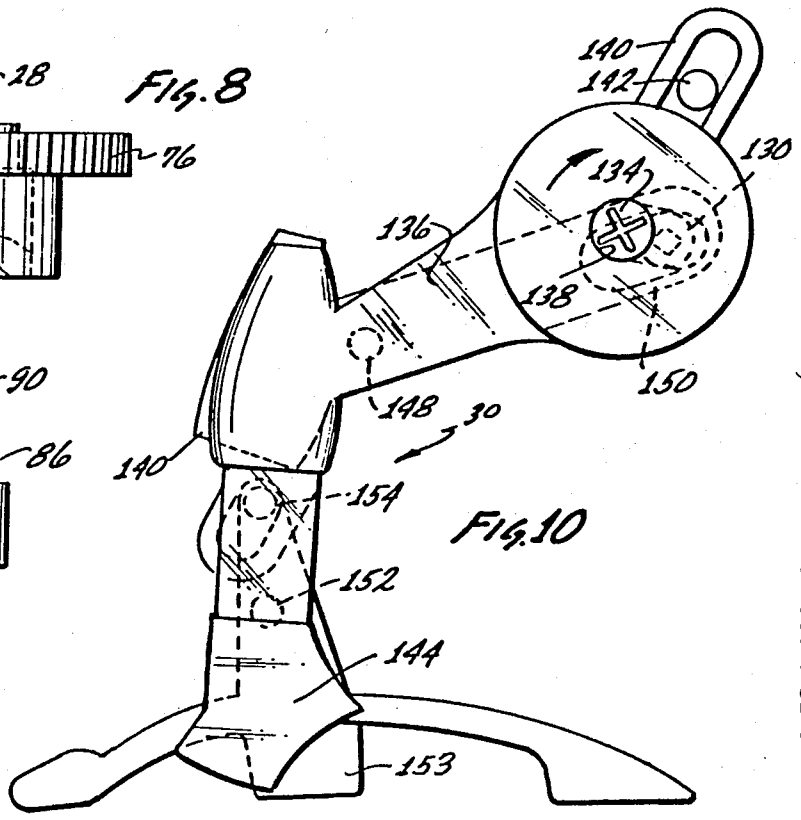
FIG. 10 is a view similar to FIG. 9 except the leg is shown in a further spatial configuration.
Figure 9:
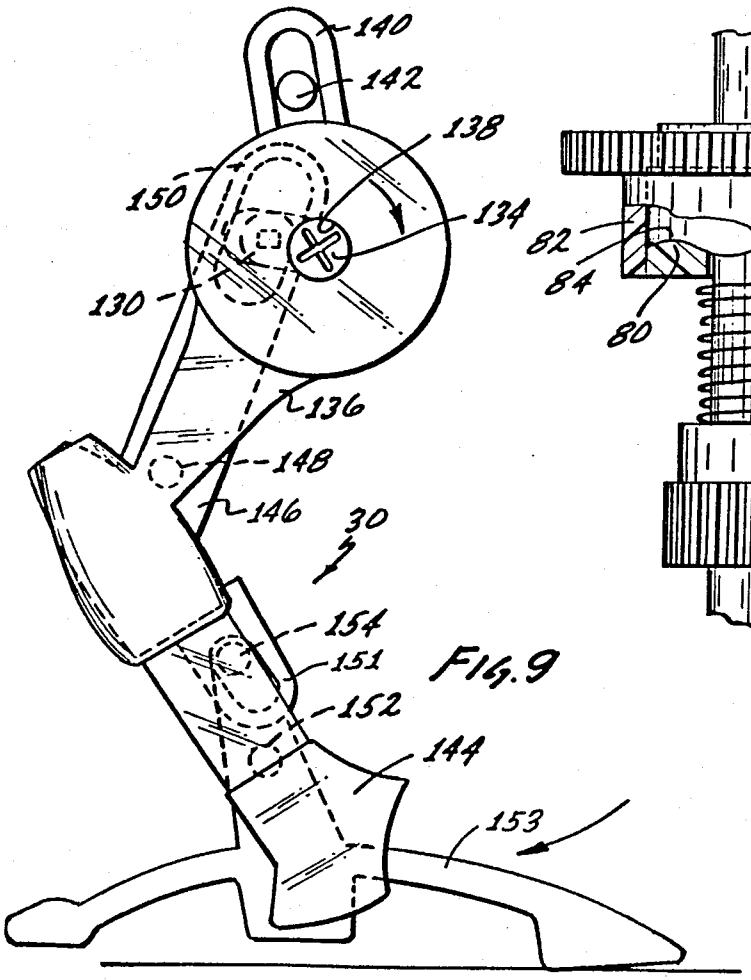
FIG. 9 is a fragmentary side elevational view of one of the legs of the embodiment of FIG. 1 showing it in a first spatial configuration.

Looking now at FIGS. 3, 9 and 10, the component parts of the legs 30 and 32 are shown as well as components attached to the drive shaft 28 which drive them. On either end of the drive shaft 28 are cranks, collectively identified by the numeral 128. Each of the cranks 128 includes a crank shaft bushing portion 130, a web portion 132 and a crank pin portion 134. The ends of the crank shaft 28 are square such that it positively engages the cranks 28 to transfer rotation to them. Each of the legs 30 and 32 have identical components which differ from each other only in that they are mirror images of each other. For this reason, the components of legs 30 and 32 which are the same but which differ from each other only in that they are mirror image components will be identified by the same numeral.

In FIGS. 9 and 10 the leg 30 is shown in detail. It includes a first leg member 136 which has a central opening 138 near its top end which is positioned on the crank pin 134 and held to the crank pin 134 by a small screw which screws into the end of the crank pin 134. Since the crank pin 134 moves in an orbit around the crank shaft 28 this also causes the central portion of the first leg member 136 located adjacent to the opening 138 to also move in an orbit. An ear 140 is located on the uppermost end of the leg member 136. It fits over a small boss 142 formed on the body 44. Since the ear 140 can only slide along the boss 142, in response to rotation of the crank pin 134 the lower end 144 of the leg member 136 moves first upwardly and then forwardly then downwardly and then backwardly as is illustrated in FIGS. 9 and 10. This moves the lower end 144 of the leg member 136 is a stepping like manner.

A second leg member 146 is pivoted at about its center via a pin 148 to the inside of the first leg member 136. The upper end of the second leg member includes an ear 150 which fits around the crank shaft bushing 130 of the crank 128. Since this bushing 128 only rotates in response to rotation of the crank shaft 28, this essentially holds the upper end of the second leg member 146 directly in line with the axis of the crank shaft 28. As the upper end of the first leg member 136 orbits about the axis of the crank shaft 28 in conjunction with orbiting of the crank pin 134 about this axis, this causes the second leg member 146 to oscillate with respct to the first leg member 136. Thus, a second ear 151 on the lower end of the second leg member 146 moves first to the forward edge of the first leg member 136 and then to the backward edge of the leg member 136 in response to rotation of the crank shaft 128 as is seen in FIGS. 9 and 10.

A third leg member 153 is connected to the first leg member 136 via a pin 152. The upper end of the third leg member 153 includes a pin 154 which rides within the ear 151 on the second leg member 146. Thus, as the ear 151 on the second leg member 146 moves backward and forward across the first leg member 136 this pivots the third leg member 153 with respect to the first leg member 136. This motion, in effect, keeps the third leg member 153 essentially in a constant horizontal plane as the first and second leg members 136 and 146 are lifted upwardly and then forwardly and then downwardly and finally backwardly in response to rotation of the crank shaft 28. As such, the third leg member 153 which gives the impression of a foot is articulated with respect to the leg 30 as the leg 30 moves.

I claim:

1. A movable toy which comprises:

a body;

a fly wheel rotatably mounted on said body;

means for rotating said fly wheel so as to energize said fly wheel;

appendage means for supporting and moving said toy on a support surface, said appendage means having ends, said appendage means pivotally connected to said body about one of said ends, the other of said ends of said appendage means contacting said support surface;

a member movably mounted on said body so as to move between a first and second position;

motion transfer means for transferring motion from said fly wheel to said appendage means, said motion transfer means operatively connectable between said fly wheel and said appendage means and further operatively associated with said member whereby when said member is in said first position said motion transfer means is connectable between said fly wheel and said appendage means and when said member is in said second position said connection between said fly wheel and said appendage means is disrupted;

said appendage means includes a first and second appendage element, each of said appendage members having ends, each of said appendage elements pivotally connected to said body about one of their ends;

said motion transfer means includes a crank shaft rotatably mounted on said body and operatively associated with said fly wheel so as to be rotated by said fly wheel, said crank shaft being elongated and including ends, said crank shaft located on said body so as to extend through said body with the respective ends of said crank shaft extending out of respective sides of said body, said crank shaft including a crank on each of its respective ends, each of said cranks of a type including a crank pin connected by a web to said crank shaft, the crank pins on each of said cranks orbiting about said crank shaft in response to rotation of said crank shaft;

each of said appendage element having a first and second appendage member, said first appendage member having ends, said first appendage member rotatably mounted to the crank pin of the respective crank associated with said appendage element, said first appendage member executing movement in response to rotation of said crank shaft, said second appendage member having ends, said second appendage member pivotally mounted to said first appendage member, said second appendage member slideably connected to said crank shaft proximal to one of the ends of said second appendage member, said second appendage member pivoting on said first appendage member in response to rotation of said crank shaft.

2. The toy of claim 1 further including:

each of said appendage elements having a third member, said third member pivotally connected to said first member proximal to the other of the ends of said first member and said third member further operatively connected to the other of said ends of said second member whereby said third member pivots with respect to said first member in response to said pivoting of said second member with respect to said first member.

3. The toy of claim 2 wherein:

the third member on each of said appendage elements includes a portion thereof which is substantially horizontally oriented when said toy is in said first position and is supported on said support surface by said appendage means.

4. The toy of claim 1 including:

biasing means associated with said member, said biasing means biasing said member from said first position to said second position;

said body further including retaining means associatable with said member, said retaining means for holding said member in said first position against the bias of said biasing means.

5. The toy of claim 4 including:

each of said appendage elements having a third member, said third member pivotally connected to said first member proximal to the other of the ends of said first member and said third member further operatively connected to the other of said ends of said second member whereby said third member pivots with respect to said first member in response to said pivoting of said second member with respect to said first member;

said retaining means further includes control means, said control means operatively associated with said motion transfer means, said retaining means moving from a retaining position to a non-retaining position in response to motion imparted to said motion transfer means from said fly wheel means, said retaining means in said retaining position retaining said member in said first position against the bias of said biasing means and said retaining means in said release position releasing said member so as said member moves from said first position to said second position under the influence of the bias of said biasing means;

said motion transfer means includes gear train means connecting between said fly wheel and said appendage means, said gear train means including a plurality of gears, at least one of said gears movable between an engagement position and a non-engagement position with one other of said gears;

said motion transfer means further including gear shifting means associated with both said movable gear and said member, said gear shifting means for moving said one of said gears from an engaged position with said one other of said gears to a non-engaged position with said one other of said gears gear, said gear shifting means engaged by said member as said member moves from said first position to said second position to move said one of said gears from said engaged position to said non-engaged position.

6. The toy of claim 1 including:

said fly wheel and said appendage means are positioned on said body so as at least a portion of said appendage means extends in a first direction away from said body and at least a portion of said fly wheel extends in a second direction away from said body with said second direction being essentially perpendicular to said first direction;

and further including said toy capable of being at least partially supported on said support surface by said fly wheel and when supported on said support surface by said fly wheel said toy moves on said surface in response to rotation of said fly wheel.

7. The toy of claim 6 wherein:

said member includes at least one wheel rotatably mounted thereon;

said member positioned on said body so as to be associated with said fly wheel when said member is in said second position whereby said body is supportable on said support surface by said fly wheel and said wheel on said member;

said member is an elongated member pivotally attaching to said body so as to be essentially perpendicular to said appendage elements when said member is in said first position and so as to be essentially parallel to said appendage elements when said member is in said second position.

8. A movable toy which comprises:

a body;

a fly wheel rotatably mounted on said body;

means for rotating said fly wheel so as to energize said fly wheel;

appendage means for supporting and moving said toy on a support surface, said appendage means having ends, said appendage means pivotally connected to said body about one of said ends, the other of said ends of said appendage means contacting said support surface;

a member movably mounted on said body so as to move between a first and second position;

motion transfer means for transferring motion from said fly wheel to said appendage means, said motion transfer means operatively connectable between said fly wheel and said appendage means and further operatively associated with said member whereby when said member is in said first position said motion transfer means is connectable between said fly wheel and said appendage means and when said member is in said second position said connection between said fly wheel and said appendage means is disrupted;

said fly wheel and said appendage means are positioned on said body so as at least a portion of said appendage means extends in a first direction away from said body and at least a portion of said fly wheel extends in a second direction away from said body with said second direction being essentially perpendicular to said first direction;

and further including said toy capable of being at least partially supported on said support surface by said fly wheel and when supported on said support surface by said fly wheel said toy moving on said surface in response to rotation of said fly wheel.

9. The toy of claim 8 wherein:

said member includes at least one wheel rotatably mounted thereon;

said member positioned on said body so as to be associated with said fly wheel when said member is in said second position whereby said body is supportable on said support surface by said fly wheel and said wheel on said member.

10. The toy of claim 9 wherein:

said member is an elongated member pivotally attaching to said body so as to be essentially perpendicular to said appendage elements when said member is in said first position and so as to be essentially parallel to said appendage elements when said member is in said second position.

11. A movable toy which comprises:

a body;

a fly wheel rotatably mounted on said body;

means for rotating said fly wheel so as to energize said fly wheel;

appendage means for supporting and moving said toy on a support surface, said appendage means having ends, said appendage means pivotally connected to said body about one of said ends, the other of said ends of said appendage means contacting said support surface;

a member movably mounted on said body so as to move between a first and second position;

motion transfer means for transferring motion from said fly wheel to said appendage means, said motion transfer means operatively connectable between said fly wheel and said appendage means and further operatively associated with said member whereby when said member is in said first position said motion transfer means is connectable between said fly wheel and said appendage means and when said member is in said second position said connection between said fly wheel and said appendage means is disrupted;

biasing means associated with said member, said biasing means biasing said member from said first position to said second position;

said body further including retaining means associatable with said member, said retaining means for holding said member in said first position against the bias of said biasing means;

said toy further includes control means, said control means operatively associated with said motion transfer means and said retaining means, said retaining means moving from a retaining position to a non-retaining position in response to motion imparted to said motion transfer means from said fly wheel means and transferred to said retaining means by said control means, said retaining means in said retaining position retaining said member in said first position against the bias of said biasing means and said retaining means in said release position releasing said member so as said member moves from said first position to said second position under the influence of the bias of said biasing means.

12. The toy of claim 11 wherein:

said motion transfer means includes gear train means connecting between said fly wheel and said appendage means, said gear train means including a plurality of gears, at least one of said gears movable between an engagement position and a non-engagement position with one other of said gears;

said motion transfer means further including gear shifting means associated with both said movable gear and said member, said gear shifting means for moving said one of said gears from an engaged position with said one other of said gears to a non-engaged position with said one other of said gears gear, said gear shifting means engaged by said member as said member moves from said first position to said second position to move said one of said gears from said engaged position to said non-engaged position.

13. A movable toy which comprises:

a body;

a fly wheel rotatably mounted on said body;

means for rotating said fly wheel so as to energize said fly wheel;

a crank shaft rotatably mounted on said body in operative association with said fly wheel so as to be rotated by said fly wheel;

said crank shaft being elongated and including ends, said crank shaft located on said body so as to extend through said body with the respective ends of said crank shaft extending out of respective sides of said body, said crank shaft including a crank on each of its respective ends, each of said cranks of a type including a crank pin connected by a web to said crank shaft, the crank pins on each of said cranks orbiting about said crank shaft in response to rotation of said crank shaft;

at least two appendage elements rotatably mounted on said body, each or said appendage elements having a first and second appendage member, said first appendage member having ends, said first appendage member rotatably mounted to the crank pin of the respective crank associated with said appendage element, said first appendage member executing movement in response to rotation of said crank shaft, said second appendage member having ends, said second appendage member pivotally mounted to said first appendage member, said second appendage member slideably connected to said crank shaft proximal to one of the ends of said second appendage member, said second appendage member pivoting on said first appendage member in response to rotation of said crank shaft;

each of said appendage elements having a third member, said third member pivotally connected to said first member proximal to the other of the ends of said first member and said third member further operatively connected to the other of said ends of said second member whereby said third member pivots with respect to said first member in response to said pivoting of said second member with respect to said first member.

14. The toy of claim 13 wherein:

the third member on each of said appendage elements includes a portion thereof which is substantially horizontally oriented when said toy is supported on said support surface by said appendage means.

15. The toy of claim 14 including:

a member movably mounted on said body so as to move between a first and second position;

biasing means associated with said member, said biasing means biasing said member from said first position to said second position;

said body further including retaining means associatable with said member, said retaining means for holding said member in said first position against the bias of said biasing means;

said toy further including control means, said control means and said retaining means operatively associated with said motion transfer means, said retaining means moving from a retaining position to a non-retaining position in response to motion imparted to said motion transfer means from said fly wheel means and transferred to said retaining means by said control means, said retaining means in said retaining position retaining said member in said first position against the bias of said biasing means and said retaining means in said release position releasing said member so as said member moves from said first position to said second position under the influence of the bias of said biasing means.

16. The toy of claim 15 wherein:

said fly wheel and said appendage elements are positioned on said body so as at least a portion of said appendage elements extend in a first direction away from said body and at least a portion of said fly wheel extends in a second direction away from said body with said second direction being essentially perpendicular to said first direction;

and further including said toy capable of being at least partially supported on said support surface by said fly wheel and when supported on said support surface by said fly wheel said toy moving on said surface in response to rotation of said fly wheel.

* * * * *

UNITED STATES PATENT AND TRADEMARK OFFICE

CERTIFICATE OF CORRECTION

PATENT NO. : 4,555,237

DATED : NOVEMBER 26, 1985

INVENTOR(S) : TERUO NIKAIDO

It is certified that error appears in the above-identified patent and that said Letters Patent is hereby corrected as shown below:

Column 2, Line 34, "if" should be --of--.

Column 4, line 31, "sour" should be --spur--.

Column 6, line 2, after the words "FIG. 11" insert the word --to--.

Column 6, line 10, delete the word "that".

Column 6, line 41, "28" should be --128--.

Column 7, line 1, the second occurrence of the numerical figure "128" should be --130--.

Column 7, line 13, "128" should be --28--.

Column 9, line 10, delete the first occurrence of the word "gear".

Column 12, line 38, delete the word "as".

Signed and Sealed this

*Twenty-second* Day of *July 1986*

[SEAL]

*Attest:*

DONALD J. QUIGG

*Attesting Officer*

*Commissioner of Patents and Trademarks*